United States Patent [19]

Futerman

[11] Patent Number: 5,074,833

[45] Date of Patent: Dec. 24, 1991

[54] METHOD OF MAKING A CONTAINER BAG

[76] Inventor: Charles S. Futerman, c/o Mulox IBC Limited, 14 Aylmer Parade, London, N2 OPF, England

[21] Appl. No.: 652,441

[22] Filed: Feb. 5, 1991

[30] Foreign Application Priority Data

May 13, 1988 [GB] United Kingdom ..... 8811348

[51] Int. Cl.[5] ..... B31B 1/86

[52] U.S. Cl. ..... 493/226; 493/384

[58] Field of Search ..... 493/210, 226, 267, 379, 493/383, 384, 254, 926; 112/262.1, 262.2, 265.1; 270/37, 53

[56] References Cited

U.S. PATENT DOCUMENTS

| | | | |
|---|---|---|---|
| 4,010,784 | 3/1977 | Nattrass et al. | 383/117 |
| 4,207,937 | 6/1980 | Sandeman | 383/17 |
| 4,300,608 | 11/1981 | Cuthbertson | 493/226 |
| 4,493,109 | 1/1985 | Nattrass | 493/226 |

FOREIGN PATENT DOCUMENTS

| | | | |
|---|---|---|---|
| 1590942 | 6/1981 | United Kingdom . | |
| 1590943 | 6/1981 | United Kingdom . | |
| 2103576 | 2/1983 | United Kingdom | 493/267 |
| 2116143 | 9/1983 | United Kingdom . | |

*Primary Examiner*—Frederick R. Schmidt
*Assistant Examiner*—Jack Lavinder
*Attorney, Agent, or Firm*—Darby & Darby

[57] ABSTRACT

A method of making an intermediate bulk container having zones (12) for the attachment of lifting loops (20) from a fabric (10) having eight such zones with lifting loops attached to the zones comprises attaching the opposite selvedges (14, 16) of the fabric together and then attaching the base (26) to complete the bag. The zones (12) are arranged in four pairs with a zone (**12*a*) of one of the pairs being adjacent to one of the fabric selvedges (14). The side seam (24**) of the bag so made is thus spaced from its adjacent corner. This means that all four lifting loops can be attached to the fabric while it is still in the flat state since no lifting loop has to cross the seam in the finished IBC>. This form of construction lends itself to automatic stitching processes and radically increases speed of production.

4 Claims, 2 Drawing Sheets

METHOD OF MAKING A CONTAINER BAG

This is a continuation of application Ser. No. 351,058, filed May 12, 1989 now abandoned.

FIELD OF THE INVENTION

This invention relates to container bags and in particular relates to a method for producing container bags for carrying loads in the range of one half to two tons known as intermediate bulk containers (IBC).

BACKGROUND OF THE INVENTION

Intermediate bulk containers are increasingly employed in cargo handling in transporting situations, especially for the carriage of particulate or pulverulent material. A typical IBC will be manufactured from a fabric woven from a polyolefin tape and have integral lifting loops. IBC's have to meet various national and international safety standards, for example it is normal to require a 5:1 safety ratio; that is, an IBC rated at one tonne should not break under loads of less than five tonnes. A particularly successful single trip IBC meeting these requirements is described in our UK Patent No. 1591091. In this, the side walls are made from a fabric having reinforced zones or areas of interwoven reinforcing yarn. The lifting loops are attached to such reinforced areas to produce an inexpensive light but sufficiently strong IBC.

One method of making such an IBC is to weave a fabric of four times the width of the eventual IBC having three pairs of reinforcing zones along its length and two further reinforcing zones approximately 15 cm inside each selvedge, making eight zones in total. The fabric is cut to length and the opposite selvedges sewn together. This produces the four side walls of an IBC having a pair of reinforced zones, or 'tramlines', adjacent each corner, one either side of the corner. A base is sewn in to the bottom edges of the side walls and the four lifting loops are attached one across each corner but each leg of a lifting loop being attached to a respective tramline. The lifting loops can be attached to the fabric before it is made up into an IBC except for the last lifting loop which crosses the side seam where the adjacent selvedges of the fabric are stitched together. This loop can only be attached when the selvedges are brought together, after which the side seam is completed. In this method of construction an average operator can produce about twelve to sixteen complete attachments (i.e. completed bags) per hour.

SUMMARY OF THE INVENTION

The invention seeks to provide a method of constructing an IBC of the type referred to which is quicker and more efficient than the method previously known in the art.

According to the present invention there is provided a method of making an IBC having zones for the attachment of lifting loops from a fabric having eight such zones with lifting loops attached to the zones, by attaching the opposite selvedges of the fabric together and attaching a base to complete the IBC, characterised in that the zones are arranged in four pairs with a zone of one of the pairs being adjacent one of the fabric selvedges, and in that the side seam of the bag made from such a fabric is spaced from the adjacent corner.

The zones are preferably reinforced zones such as 'tram lines' referred to above. By shifting the tramlines so that an end tramline is adjacent the fabric selvedge, all four lifting loops can be attached to the fabric while it is in a flat state since the final lifting loop can be sewn as the same time as it does not now have to cross a seam in the finished IBC. This form of construction lends itself to automatic stitching processes whereby all eight legs of lifting loops can be attached to their respective tramline simultaneously. By the method of the invention the output of IBC's can be increased from approximately twelve complete attachments per operator per hour to fifty or sixty per operator per hour.

BRIEF DESCRIPTION OF THE DRAWINGS

The invention will be described further, by way of example, with reference to the accompanying drawings, in which.

DESCRIPTION OF A PREFERRED EMBODIMENT

Figure 1:
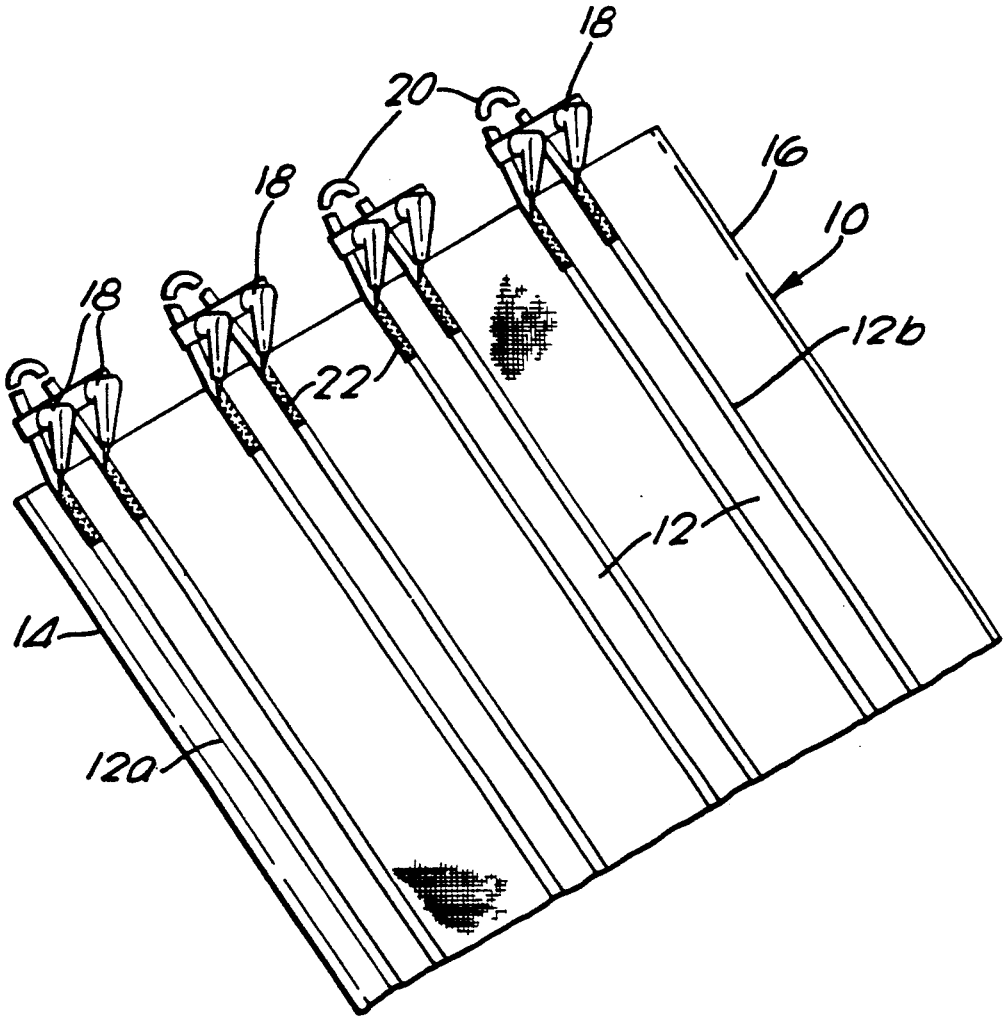
FIG. 1 illustrates in a diagrammatic manner the attaching of the lifting loops to an IBC fabric in accordance with the invention.

Referring to the drawings, a fabric 10 is woven with four pairs of reinforcing zones 12 of interwoven reinforcing threads, referred to as 'tramlines'. The tramlines are in four pairs with the end tramline 12*a* of one of the pairs adjacent to one selvedge 14 of the fabric. That is, the tram line 12*a* is much closer to the selvedge than the 15 cm usual in the conventional method referred to hereinabove, e.g. 2 cm or 3 cm away. The tramline 12*b* at the opposite side is spaced at a greater distance from its respective selvedge 16, the distance being similar, but slightly less, than that between adjacent pairs of tramlines. As illustrated, four pairs of sewing heads 18 are stitching four lifting loops 20 to the pairs of tramlines 12. Each leg 22 of a lifting loop 20 is stitched to its respective tramline 12 by a preferred stitching pattern either repeated a number of times or continuously sewn. In this manner all four lifting loops are attached simultaneously to the fabric 10 in one operation.

Figure 2:
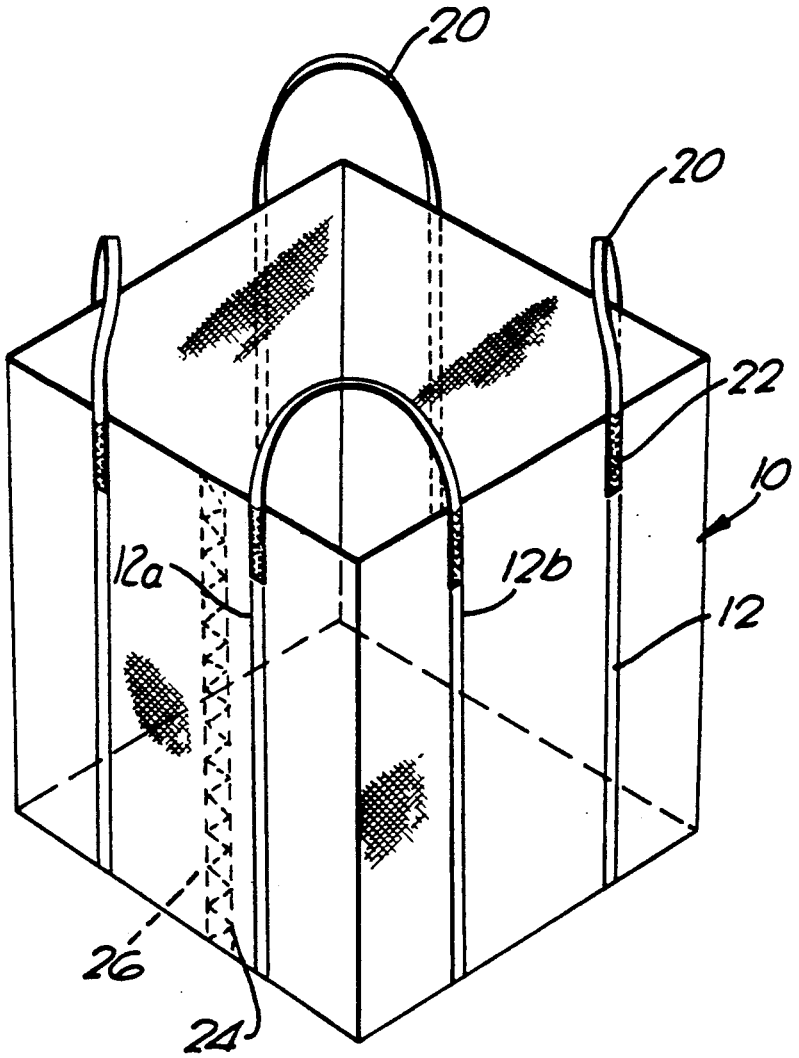
FIG. 2 is a diagrammatic elevational view of an IBC constructed in accordance with the invention.

Fabric 10, which has previously been cut to length, is then removed from the stitching heads and the opposite selvedges 14, 16 are brought together to form a side seam 24 (FIG. 2). As can be seen from FIG. 2, the side seam 24 is not at the corner of the bag but is spaced therefrom and is adjacent to the tramline 12*a*. A square base 26 is sewn to the bottom of the bag as previously known. Furthermore the bag may be provided with a top cover, filling spout, liner, or the like as is usual in the IBC art.

By the apparently simple expedient of shifting the side seam 24 from a corner of the bag to a position adjacent the tramline 12*a* the stitching on of the loops 20 can be automated and bag production increased five- or six-fold.

It will be appreciated that, while the invention has been described with reference to IBC's having tramlines such as those described in our UK patent No. 1591091, it is not so limited and may be used wherever it is wished to construct a square bag with a single side-seam and lifting loops over each corner.

The method of the invention is considerably more efficient than the hitherto employed method of producing IBC's of the type described having a single side seam.

The invention extends to an IBC having a single side seam spaced from its adjacent corner.

I claim:

1. A method of making a container bag having sides which together comprise a single piece of fabric, the fabric having eight zones for attaching lifting loops, the zones being arranged so that pairs of adjacent zones each define between them a generally vertical fold line, comprising the steps of:

simultaneously attaching four lifting loops to the fabric while the fabric is in a flat state, each loop straddling one of the vertical fold lines;

aligning opposite vertical free edges of the fabric; and seaming together the opposite free edges of the fabric with a seam which is generally parallel to the vertical fold lines and which is not straddled by a lifting loop.

2. A method as claimed in claim 1 in which the zones are reinforced zones.

3. A method as claimed in claim 2 in which the zones are areas of interwoven reinforcing yarns running lengthwise along the fabric.

4. A method as claimed in claim 1 in which the bag is additionally provided with a top cover, filling spout liner or the like.

* * * * *